United States Patent [19]

Scholle

[11] 4,355,742

[45] Oct. 26, 1982

[54] DISPENSER SPIGOT FOR VISCOUS MATERIAL

[75] Inventor: William R. Scholle, Corona del Mar, Calif.

[73] Assignee: Scholle Corporation, Northlake, Ill.

[21] Appl. No.: 9,544

[22] Filed: Feb. 5, 1979

[51] Int. Cl.[3] ..... B65D 25/48

[52] U.S. Cl. ..... 222/490; 220/257; 222/505; 222/545

[58] Field of Search ..... 222/511, 517, 505, 490, 222/545, 541, 152; 220/256–259

[56] References Cited

U.S. PATENT DOCUMENTS

| | | | |
|---|---|---|---|
| 3,086,679 | 4/1963 | Bijvoet | 220/257 X |
| 3,227,330 | 1/1966 | Sadler | 222/545 X |
| 3,429,475 | 2/1969 | Scholtz | 220/257 |
| 3,800,972 | 4/1974 | Raymond | 220/256 X |
| 3,966,080 | 6/1976 | Bittel | 222/541 X |
| 3,972,452 | 8/1976 | Welsh | 222/511 X |

*Primary Examiner*—F. J. Bartuska
*Attorney, Agent, or Firm*—Gary, Juettner & Pyle

[57] ABSTRACT

A spigot for dispensing viscous contents of a container having a filling and dispensing spout comprises an integral elastomeric member having a recessed, transverse diaphragmic wall adapted to fit within the spout and form a seal therewith; an annular radial flange at the outer end of the transverse wall having an arcuate slit therethrough extending a significant angle therearound; and a manipulatable lever on the transverse wall for flexing portions of the wall and the slit portions of the flange to move said portions away from the spout to open the slit and provide a large area dispensing opening through the spigot, the tranverse wall and flange automatically and resiliently snapping back toward spout sealing position upon release of the manipulatable lever. To ensure the integrity, or if sterile, the sterility of the contents until such time as they are to be dispensed, an overlay of thermoplastic or other material may be sealed across and to the flange to cover over and close the slit and facilitate use of the spigot as a drip free shipping cap for a filled container. To minimize passage of atmospheric gases through the spigot, or through any elastomeric closure for the spout, whereby to prevent oxidation of packaged product, an overlay may be provided of gas barrier material and the recess or hollow defined by the transverse wall may be filled with a gas scavenger material or inert gas; or gas barrier material may be placed around the entirety of the spout and closure and sealed to the container.

10 Claims, 8 Drawing Figures

DISPENSER SPIGOT FOR VISCOUS MATERIAL

BACKGROUND OF THE INVENTION

Bag-in-box packaging of a variety of commodities is becomingly increasingly more popular due to its economy, convenience and storage capabilities. The package, which is entirety disposable, consists of a flexible plastic bag for reception of the commodity in a sterile, air-free noncontaminant environment, and a paperboard box for reception of the filled bag to facilitate safe transportation and handling of the same. The bag is equipped with a tubular spout through which the bag may be filled and the contents subsequently dispensed, and the box is provided with perforated tabs adjacent the location of the spout within the box to facilitate access to, removal of and mounting of the spout in a wall of the box near the bottom thereof for dispensing of the contents. Examples of commodities economically packaged in this manner include liquid products, such as milk, juice, and wine, and viscous products, such as tomato paste, ketchup, and the like.

For convenient gravity dispensing of liquid contents, the spout is usually equipped with a valve or spigot. One form of spigot currently employed comprises an integral elastomeric member defining a diaphragmic transverse wall of deeply concave shape adapted to be inserted into the spout in sealing engagement with the outer end or lip of the spout and having a finger manipulatable means on the wall for distorting a portion thereof from concave to convex configuration and disengaging said portion from the lip of the spout to permit gravity dispensing of the contents, the wall snapping back into sealing position upon release of finger pressure. This spigot is shown and described in U.S. Pat. No. 3,400,866 to L. A. Fattori, and in an improved version in U.S. Pat. No. 3,443,728 to W. R. Scholle, the instant applicant.

As point out in the introductory portion of the Fattori patent, this spigot enjoys the advantages of being sufficiently low in cost for incorporation in a disposable container of the type above described, practical and efficient for shipping, storing and dispensing in a wide variety of liquid food products, such as milk, juices and wine; operable at food refrigerating temperatures; neat and aesthetic in appearance; foolproof in operation; easy to operate allowing a flow of liquid by exertion of finger pressure of one hand, leaving the other hand free for holding a receiving receptacle, rapid and automatic shutoff upon release of the finger pressure; generally free of drip or liquid hangup after shutoff; and generally not prone to leaking after passage of time or exposure to shock loading. In addition, because the spigot can be easily snapped onto and off of the spout, the spigot is compatible for filling containers through the delivery spout using high speed automatic machinery, closure of the container being effected after filling by snap-on engagement of the spigot which simultaneously loads the latter in prestressed shutoff position.

It would be desirable to have a similar form of dispensing spigot for viscous materials, such for example as ketchup. However, the Fattori spigot is not capable of dispensing relatively viscous materials, In particular, because the dispensing opening through the spigot is small and comprises only a small percentage of the total area of the spout, viscous materials will flow through the spigot under force of gravity only at an unacceptably reduced or slow rate, if at all. Consequently, for viscous materials, it is customary to close the spout with a single cap or closure for shipment, and to dispense the contents by removing the cap and either pouring or pumping the contents out of the bag through the spout.

Another problem encountered with elastomeric closures, whether they be simple closure caps or dispensing spigots, is the transmission of air through the closure and consequent oxidation of the contents of the package. For example, the Fattori type of closure effects its seal on the lip of the spout essentially at a circular line of contact with the spout, with the result that the spigot is not capable of withstanding large internal pressures without leaking air into the product. In consequence, the spigot does not adequately protect contained product against oxidation when stored for long periods of time before dispensing.

One effort to overcome the air leakage deficiency of the Fattori spigot is shown in U.S. Pat. No. 3,972,452 to W. C. Welsh. As shown in this patent, the deeply concave wall of the Fattori spigot was further equipped with an axially inwardly extending flange-like wall purportedly intended to gain additional bearing surface and sealing area on the interior surface of the spout.

SUMMARY OF THE INVENTION

In accordance with the present invention, a dispensing spigot for viscous materials is provided by forming the integral elastomeric member of Fattori (or any comparable closure) with its transverse wall adapted to be inserted into the spout in sealing engagement therewith and with a radially outwardly extending annular wall or flange at the outer end of the transverse wall, and by providing an arcuate slit in said radial flange extending a substantial portion of the way therearound, preferably about halfway around. Manually manipulatable means comprising a finger grip is provided on the transverse wall for flexing a portion of the wall and the slit portion of said flange radially inwardly and axially outwardly of the spout to open the slit and provide a large dispensing opening through the spigot of an area on the order of at least about one half the area of the spout, whereby viscous materials may conveniently be dispensed by gravity through the spigot. As with Fattori, upon release of finger pressure, the flexed portions of the transverse wall and flange resiliently return toward their spout sealing positions.

The spigot may initially be formed imperforate to ensure the integrity of the packaged product until such time as the contents are to be dispensed, the ultimate user or purchaser then slitting open the spigot along an arc indicated on the flange by a previously applied marking, scoring or indenting. Then, by pulling on or manipulating the finger grip, the user may open the spigot to an extent of 50% or greater of the area of the spout. In the alternative, to ensure the integrity of the package in the situation where the slit is preformed in the spigot, an overlay of thermoplastic or other material may be sealed to and across the flange to enclose the slit, whereby the slit spigot may safety be used as a shipping cap for a filled container. Later, the overlay may simply be removed or peeled from the spigot when it is desired to dispense the contents.

Further in accordance with the invention, the transmission of atmospheric gases through an elastomeric closure, whether a simple cap or a dispensing spigot, is greatly minimized by providing the closure with a sealed overlay formed of a gas barrier material and by filling the recess or hollow defined in the area between the overlay and the recessed or concave transverse wall of the closure with an oxygen scavenger compound or inert gas. In another embodiment, a complete gas barrier is provided for both the spout and closure by encapsulating the entirety of the same within a gas barrier material sealed to the container, preferably over an inner flange of the spout which connects with the container. The gas barrier material may also be sealed to the outer annular flange of the spigot and/or an oxygen scavenger compound or inert gas may be injected into the sealed interior of the gas barrier material.

Consequently, the spigot of this invention can accommodate far greater dispensing rates of viscous or other materials than spigots of a like type heretofore known. When provided with a gas barrier overlay with or without an oxygen scavenger compound or inert gas, the spigot has significantly lower rates of oxygen transmission, which is very important in the packaging of food products subject to deterioration by oxidation, and may be used as a shipping cap with minimum susceptibility to leakage even when used to package liquids having a great propensity for leaking, such as wine.

Other objects, advantages and features of the invention will become apparent from the following detailed description taken in conjunction with the accompanying drawings.

DETAILED DESCRIPTION

Figure 1:
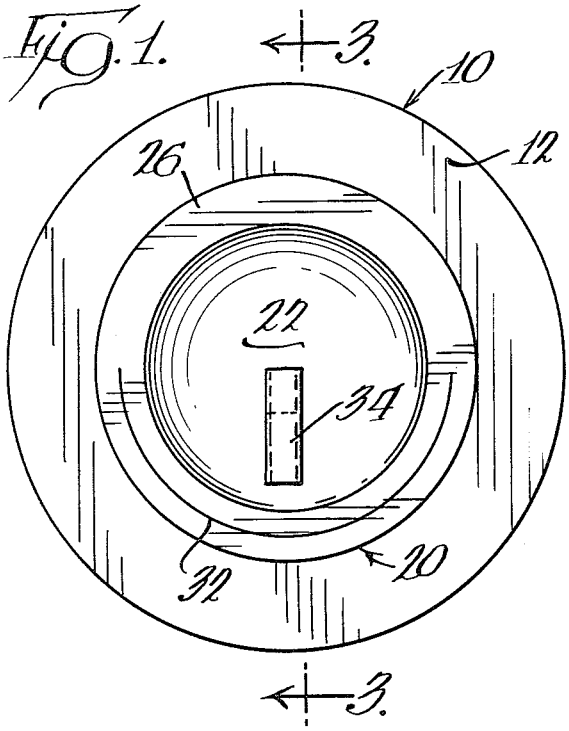
FIG. 1 is a front view of a preferred form of spigot embodying the teachings of the present invention, the view showing the spigot in closed position on a spout.

Referring to the drawings, the numeral 10 denotes a tubular spout open at its ends and having a relatively large diameter outwardly extending flange 12 at its inner end for sealed connection with a container, such as a flexible plastic bag used for bag-in-box packaging. The spout may be injection molded of a semi-rigid resinous plastic, such as polyethylene, vinyl or the like, and has intermediate its ends at least two axially spaced radially outwardly extending flanges 14 which are used in a known manner to facilitate filling of the bag through the spout and to mount and lock the spout in an aperture adjacent the bottom of the box when it is desired to dispense the contents of the bag. At its outer end or lip the spout includes at least one relatively small diameter radially outwardly extending flange 16 which aids in retaining the spigot on the spout, as will be described.

A spigot of a structure which may advantageously embody the teachings of the present invention is indicated generally at 20 and comprises an integrally molded elastomeric member having a diaphragmic transverse wall 22 of deeply concave shape adapted to be inserted into the spout for distension into sealing engagement with the outer end or lip 24 of the spout for closing off the spigot and the spout. In accordance with the invention, an outer annular flange or wall 26 extends radially outward from the outer end of the diaphragmic wall.

For securely but detachably mounting the spigot on the spout, the spigot includes a cylindrical peripheral wall or tubular skirt 28 extending axially inwardly from a location generally centrally of the flange 26 and sized to telescope onto the outer end of the spout 10. The walls 22, 26 and 28 together define a generally frustoconical recess for slidable reception of the lip and outer portions of the spout. The skirt is of a length to abut against the outermost of the flanges 14, thereby to define a stop for predetermination of the extent of insertion of the spigot onto the spout. The skirt is also provided inwardly of the spout flange 16 with a complementary annular flange 30 for detachably locking the spigot to the spout.

The spigot may be integrally formed by injection molding of any suitable plastic resinous material having elastomeric properties, such as polyolefins, polyvinyls, polyurethanes, ethylene vinyl acetate and the like, as a unitary capping structure for the free end of the spout 10. Accordingly, upon the spigot being pressed onto the spout the diaphragmic wall 22 is engaged and distended by the lip of the spout into sealing contact therewith, and the outward pressure or head of packaged liquid against the relatively large inner surface area of the wall creates radially outward pressures forcing the wall against the spout to enhance the seal.

To the extent thus far described, the member 20 corresponds with an existing spout sealing closure cap of integral construction having imperforate walls 22, 26 and 28, and adapted to have its diaphragmic wall 22 effect a circular seal with the lip 24 of the spout 20 in essentially the manner described in Fattori U.S. Pat. No. 3,400,866. It differs from Fattori principally in that the wall 28 is imperforate and does not have a radial dispenser opening therein.

As described in the Fattori patent, the spout 10 and the closure or spigot 20 are compatible with requirements for use in high speed automatic filling and packaging machinery. In particular, the groove formed between the adjacent flanges 14 may be engaged by grippers or guides of such machinery for supporting the spout in upright position for filling the container. To this end, the closure or spigot may be placed on the spout subsequent to filling, or in order to maintain integrity, or if sterile, the sterility of the container, it may be positioned on the spout during manufacture of the container, and later removed for purposes of filling. In any event, the portions of the flanges 26 extending radially outward from the skirt 28 provide a convenient gripping area for either manual or automated removal of the closure or spigot to facilitate filling through the spout, followed by reapplication of the spigot to the spout. Thus, the spigot or closure may be applied to the spout at the time of manufacture of the container to maintain internal sterility (if sterile) during transport and handling of the empty container, as well as after filling.

In accordance with the present invention, to provide for dispensing of relatively viscous materials, and as best shown in FIG. 1, an arcuate slit 32 is formed in the spigot flange 26 radially outwardly of the wall 22 around a substantial arcuate portion of the flange, preferably in an arc of 180° or more. Due to the location and arcuate extent of the slit, the spigot may be opened to an extent of 50% or greater of the area of the spout, as will be described, thereby to readily accommodate dispensing of viscous materials.

In particular, to open the spout, finger manipulatable or gripping means 34 are formed integrally with the diaphragmic wall 22. The means is generally in the form of a rectangular bar, and occupies an area on the diaphragmic wall extending radially outwardly from the center of the arc of the slit 32 toward a medial or bisecting point along the arc. Formed on opposite sides of the bar 34 are ridges 36 which give the walls a nonslip gripping surface, and the bar extends outwardly from the diaphragmic wall toward, but preferably not beyond, the axially outermost surface of the flange 26. Consequently, the finger grip is housed entirely within the concave hollow or recess defined by the diaphragmic wall so that the same cannot accidentally or inadvertently be operated during shipment, handling or storage of the container. Overt, intentional action of an operator is required to open the spigot, so that inadvertent opening of the spigot and loss of contents is prevented. On the other hand, however, especially if the spigot is not to be employed as a shipping closure, the finger grip 34 can extend axially outwardly beyond the flange for even more facile operation of the spigot.

Figure 2:
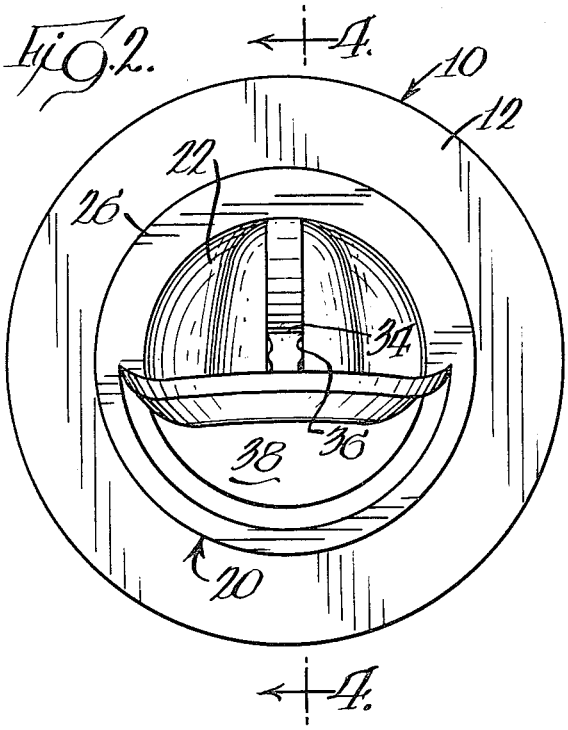
FIG. 2 is a front view of the spigot, showing the same in open position and providing a large area opening therethrough.
Figure 3:
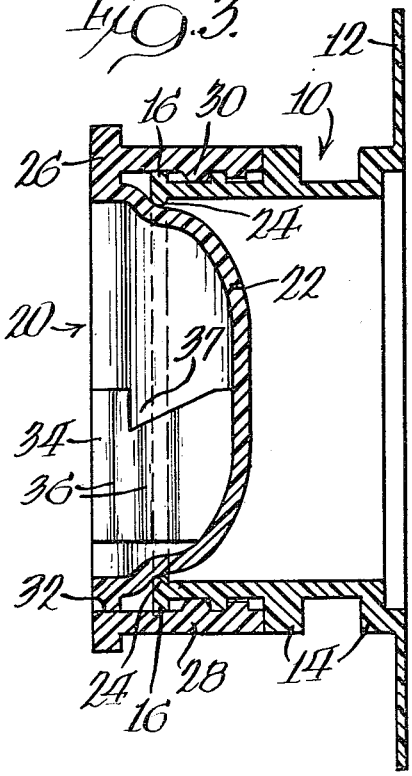
FIG. 3 is a vertical section of the spigot and associated spout taken substantially along the line 3—3 of FIG. 1, with the spigot in its closed position.
Figure 4:
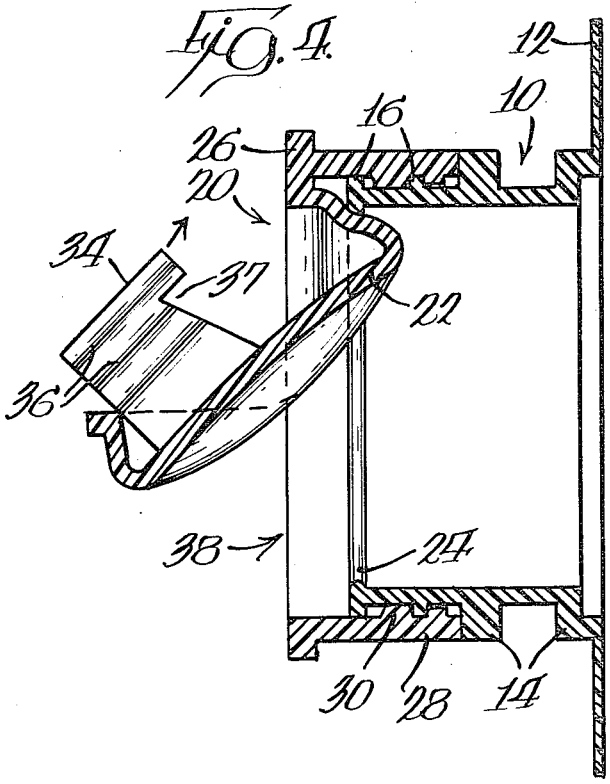
FIG. 4 is a vertical section of the spigot and spout taken substantially on the line 4—4 of FIG. 2, illustrating the spigot in its open position.

To dispense contents, and with the spigot 20 oriented at the bottom of a container in the position shown in FIGS. 3 and 4, a person may place a receptacle under the outer end of the spigot, grip the bar 34 between thumb and forefinger, and pull the bar outwardly of the spout and spigot. As the user pulls on the bar the arcuate portion of the flange 26 inwardly of the slit 32, together with the adjacent portions of the diaphragmic wall 22, are moved in an arcuate path generally radially inwardly and axially outwardly of the spout until the diaphragmic wall assumes a configuration which is the same as or approaches that shown in FIGS. 2 and 4. In this manner the portions of the diaphragmic wall aligned with the slit are moved away from the lip or sealing surface 24 of the spout to form a large area dispensing opening or path of egress 38 in communication with the interior of the spout. When the slit 32 extends along an arc of at least 180°, the user may form a dispensing opening in the spigot to an extent of 50% or greater of the area of the spout simply by pulling on the finger grip to convert a portion of the diaphragmic wall from its normal concave configuration to the configuration illustrated in FIGS. 2 and 4. Alternatively, the user may simply push upwardly on the bottom of the bar 34 to open the slit for dispensing of contents. In either mode of operation, upon release of the finger grip, the diaphragmic wall snaps back toward its initial concave position against the sealing surface 24 of the spout normally to restore the seal and discontinue dispensing of the contents of the container. However, with extremely viscous materials, it may also be necessary to press inwardly on the bar to ensure complete closing and resealing of the spigot.

When dispensing copious quantities of a bulk packed product, it may be desirable to latch the spigot in open position. For the purpose, the upper edge of the finger grip bar 34 is notched, as indicated at 37, so that the bar can be swung and/or stretched in the direction of the arrow in FIG. 4 and latched over the upper edge portion of the flange 26.

Thus, it is seen that the relatively great distance between opposite ends of the arcuate slit 32, combined with the positioning of the finger gripping bar 34 to extend generally radially outwardly from the center point of the slit toward a medial position therealong ensures convenient opening and closing of a very large path of egress from the container for convenient, high flow rate, dripless dispensing of viscous materials.

It is understood, of course, that while the spigot 20 has been described as having a concave diaphragmic transverse wall which forms a seal with the lip of the spout, the teachings of the invention could just as readily be incorporated in other spigots of the same general type but different configurations, for example those having a generally cylindrical wall extendable into the spout for forming a seal at a position axially remote from the lip of the spout.

To ensure the integrity and effectiveness of the closure provided by the spigot and spout, thereby to provide greater security in use of the spigot as a drip free shipping cap, the spigot as supplied to a user may be imperforate. In this case, a marking, scoring or indenting is formed along the flange 22 whereat the slit 32 is to be formed, and the ultimate user, i.e., the purchaser of the filled container, may then slit open the spigot along the 180° or greater arc indicated by such indicia. Thereafter, by pulling outwardly or pushing upwardly on the finger grip 34 the user may conveniently control dispensing of contents through the large area opening formed through the spigot.

Figure 5:
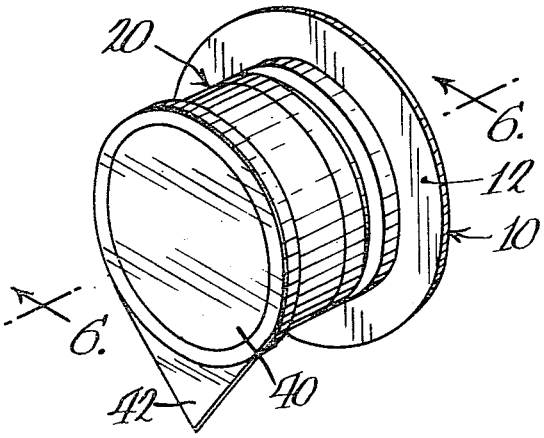
FIG. 5 is a perspective view of the spigot in accordance with an embodiment of the invention in which an overlay of gas barrier or other material is sealed to an outer end of the spigot.
Figure 6:
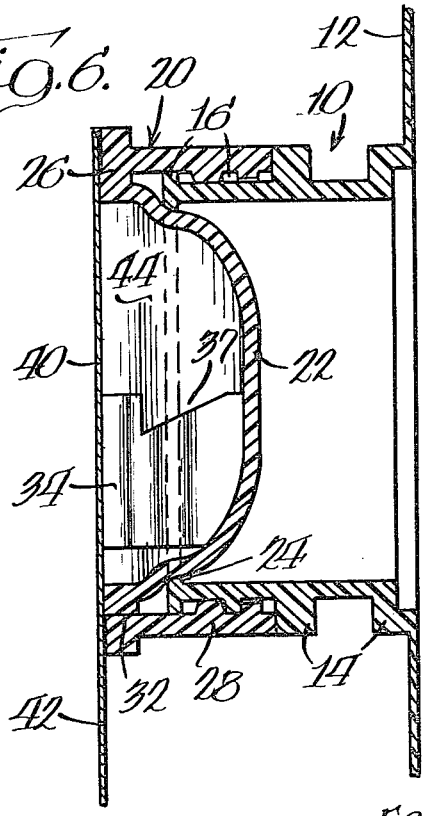
FIG. 6 is a vertical section taken substantially on line 6—6 of FIG. 5, illustrating the connection of the overlay with the spigot.

As an alternative to initially forming the spigot imperforate, in accordance with another embodiment of the invention as shown in FIGS. 5 and 6, an overlay 40 of thermoplastic or other material may be sealed to and across the flange 26 radially outwardly of the slit 32 to maintain the aseptic condition of the container and accommodate secure use of the slit spigot as a shipping cap for a filled container. The overlay may be sealed to the flange in any convenient manner, but preferably is heat sealed thereto, and is provided with a tab 42 to facilitate convenient removal or peeling thereof from the spigot in order to dispense the contents. The overlay also protects the finger grip 34 from inadvertent displacement during shipment and handling.

In addition to the foregoing, a further disadvantage of elastomeric closures of the general type referred to herein resides in the fact that the closure member, being formed of elastomeric materials and having relatively limited sealing contact with the interior of the spout, is susceptible to transmission of atmospheric gases, especially oxygen, to the interior of the container. It is desirable to minimize such transmission of gases, particularly where the contents of the containers are of a type which deteriorate upon oxidation, for example tomato paste and wine. When such products are packaged in a flexible container, the container may be formed of gas barrier material, such as multiple plies of thermoplastic film or a ply of metal film or metallized polymer film confined between outer plies of thermoplastic film, which significantly decreases the passage of oxygen to the interior of the bag. In this case then, a primary source of oxygen leakage to the product comprises the closure itself.

In accordance with a further embodiment of the invention, to decrease the transmission of gases through the spigot or closure 20, the overlay 40 is formed of gas barrier material, such as above described for a flexible container. By itself, such overlay offers considerable resistance to passage of gases through the spigot, as well as affording the advantages above described. To further increase the effectiveness of the barrier, however, an oxygen scavenger material, such as a sulfite compound, or an inert gas, may be encapsulated by the overlay within the recess, hollow or cavity 44 formed in the concave area defined by the diaphragmic wall 22. Such a compound or gas is effective in maintaining the integrity of the packaged product irrespective of whether the slit 32 is formed in the flange 26 initially or by a later user of the packaged product, or the closure is merely a cap and not a dispensing spigot. In the resultant structure, the overlay 40 and/or the scavenger protect the diaphragmic wall 22 from axial transmission of gases, and the peripheral portions of the multiple walls 22 and 28, together with the spout 10, protect against lateral transmission of gases.

Figure 7:
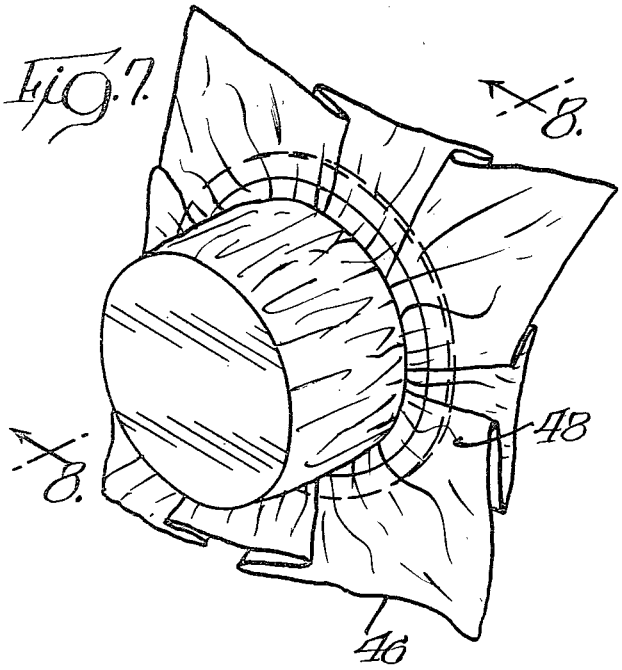
FIG. 7 is a perspective view of the spigot in accordance with another embodiment of the invention, in which an overlay of gas barrier or other material encapsulates the entirety of the spigot and the spout on which it is placed.
Figure 8:
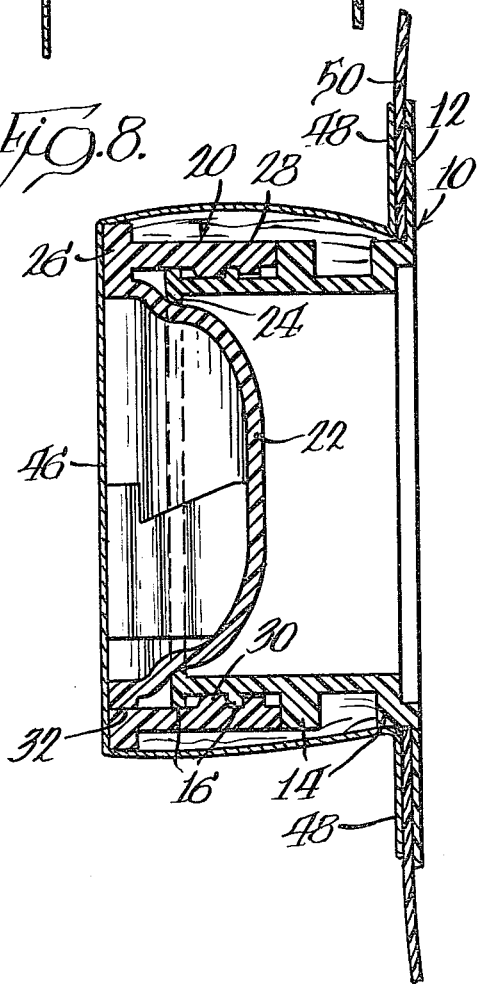
FIG. 8 is a vertical section taken substantially along line 8—8 of FIG. 7, illustrating the connection of the overlay about an inner flange of the spout which connects with a container.

In yet another embodiment of the invention, as shown in FIGS. 7 and 8, a complete gas barrier is provided for the entirety of the spout and the spigot or closure, to ensure maximum resistance to gas transmission. In this case, a sheet of gas barrier material 46, which may be flat but which preferably is preformed to complement the spigot and spout, is conformed around the entirety of the closure and spout assembly to completely encapsulate the same. The sheet in being conformed to the closure and spout is flared outwardly at its end margins to form a skirt 48 adapted to be sealed to a container about the spout flange 12, preferably by heat and/or pressure sealing, and along with a container of gas barrier material forms a package, all outer areas of which are highly resistant to passage of gases. In some embodiments, the overlay 46 may be sealed directly to the spout flange 12. However, it is more or less customary in the art for the flange 12 to be secured (in known manner) to the inner surface of the material 50 forming a flexible plastic bag, in which event the skirt 48 of the overlay 46 is heat and/or pressure sealed to the outer surface of the flange supported portion of the bag 50, as shown in FIG. 8. It is further contemplated that the overlay may also be sealed to the spigot flange 26, radially outwardly of the slit 32 if provided, which is advantageous if the closure is initially formed with a slit or if it is desired to contain an inert gas or a gas scavenger compound in the cavity formed by the diaphragmic wall 22.

The invention thus provides an improved spigot which is capable of dispensing relatively viscous materials at a high rate of flow. In use of the spigot as a leak proof cap for preservation of the contents during storage, shipment and handling, the spigot may initially be formed imperforate for being slit open by an ultimate purchaser of the packaged product or, simply, an overlay may be sealed to the outer end of the spigot. To protect the packaged product against oxidation, and whether or not the spigot is initially slit, the overlay may be of a gas barrier material, and an oxygen scavenger compound or inert gas may be encapsulated by the overlay. The closure or spigot thus has all of the advantages of prior closures and spigots of the general type, and greatly enhanced dispensing and product preservation characteristics as well.

While certain preferred embodiments of the invention have been described in detail, it is to be understood that various changes, rearrangements and modifications may be made therein, and other embodiments thereof devised by persons skilled in the art, without departing from the spirit and scope of the invention as defined by the appended claims.

What is claimed is:

1. A dispensing spigot for a container having a spout, comprising an integral elastomeric member having transverse wall means adapted to be inserted into the spout in sealing engagement therewith, a flange at an outer end of said transverse wall means extending generally laterally therefrom, said flange having an elongate slit therein laterally outwardly of said transverse wall means extending over a major portion of the marginal extent of said flange, and manipulatable means on said transverse wall means for flexing the portions of said transverse wall means inwardly of said slit generally radially inwardly away from the spout and for flexing the portions of said flange inwardly of said slit both radially inwardly and generally longitudinally outwardly away from the spout to open up said portions of said transverse wall means and said flange and provide a large mouth dispensing opening through the flexed portions of said transverse wall means and said flange.

2. A spigot as in claim 1, said slit extending over at least about half of the marginal extent of said flange, whereby said dispensing opening has an area to an extent of at least about 50% of the area of the spout.

3. A spigot as in claim 1, said elastomeric member being manufactured without the slit cut therethrough and bearing indicia thereon for formation of the slit by the ultimate user.

4. A spigot as in claim 1, said manipulatable means including latch means for detachable engagement with the portions of said flange opposite said slit for releasably latching the spigot in open position.

5. A spigot as in claim 1, including an overlay of sheet material sealed to and across said flange laterally outwardly of said slit for foreclosing passage through said spigot, said overlay being removable in order to dispense contents through said spigot.

6. A spigot as in claim 5, said transverse wall means defining a hollow recess between itself and said overlay, and including a gas barrier compound encapsulated within said recess by said overlay.

7. A dispensing spigot for a container having a spout, comprising an integral elastomeric member having transverse wall means adapted to be inserted into the spout in sealing engagement therewith, a flange at an outer end of said transverse wall means extending generally laterally therefrom, said flange having an elongate slit therein laterally outwardly of said transverse wall means extending over a major portion of the marginal extent of said flange, and manipulatable means on said transverse wall means for flexing the portions of said transverse wall means inwardly of said slit generally radially inwardly away from the spout and for flexing the portions of said flange inwardly of said slit both radially inwardly and generally longitudinally outwardly away from the spout to open up said portions of said transverse wall means and said flange and provide a large mouth dispensing opening through the flexed portions of said transverse wall means and said flange, said slit being generally arcuate and said manipulatable means occupying a portion of said transverse wall means which extends radially outwardly from about the center of the arc of said slit toward a medial or bisecting point along the arc of said slit, said manipulatable means upon movement in directions radially inwardly and axially outwardly of said spigot causing the portions of said transverse wall means and said flange inwardly of said slit to be flexed radially inwardly and axially outwardly to move the same away from the spout to open said slit and form a large dispensing opening, said portions of said transverse wall means and flange resiliently returning in the direction of their spout sealing positions upon release of said manipulatable means.

8. A dispensing spigot for a container having a spout, comprising an integral elastomeric member having a diaphragmic transverse wall of recessed configuration adapted to be inserted into the spout for sealed engagement with the spout, an annular flange at an outer end of said transverse wall extending radially therefrom, said flange having an elongate arcuate slit therein radially and longitudinally outwardly of said transverse wall and extending a major arcuate extent therearound, and manipulatable means on said transverse wall for flexing the portions of said transverse wall inwardly of said slit generally radially inwardly away from the spout and for flexing the portions of said flange inwardly of said slit both radially inwardly and longitudinally outwardly away from the spout to open up the portions of said transverse wall and said flange and provide a large mouth dispensing opening through the flexed portions of said transverse wall and said flange.

9. A spigot as in claim 8, said slit extending through an arc of at least about 180°, whereby said dispensing opening has an area to an extent of at least about 50% of the area of the spout.

10. A dispensing spigot for a container having a spout, comprising an integral elastomeric member having a diaphragmic transverse wall of recessed configuration adapted to be inserted into the spout for sealed engagement with the spout, an annular flange at an outer end of said transverse wall extending radially therefrom, said flange having an elongate arcuate slit therein radially and longitudinally outwardly of said transverse wall and extending a major arcuate extent therearound, and manipulatable means on said transverse wall for flexing the portions of said transverse wall inwardly of said slit generally radially inwardly away from the spout and for flexing the portions of said flange inwardly of said slit both radially inwardly and longitudinally outwardly away from the spout to open up the portions of said transverse wall and said flange and provide a large mouth dispensing opening through the flexed portions of said transverse wall and said flange, said manipulatable means comprising a lever occupying a portion of said transverse wall which extends radially outwardly of the center of the arc of said slit and toward a medial or bisecting point along the arc of said slit, said lever being movable radially inwardly and axially outwardly of said spigot to flex the portions of said wall and said flange inwardly of said slit to move the same away from the spout to form said dispensing opening.

* * * * *